United States Patent [19]

Anderson

[11] 4,410,184

[45] Oct. 18, 1983

[54] ARROWHEAD HAVING MODULAR REMOVABLE BLADES

[76] Inventor: Jeffrey J. Anderson, P.O. Box 11, McCann Mill Rd., Pottersville, N.J. 07979

[21] Appl. No.: 309,487

[22] Filed: Oct. 7, 1981

[51] Int. Cl.[3] ..... F41B 5/02

[52] U.S. Cl. ..... 273/422

[58] Field of Search ..... 273/422

[56] References Cited

U.S. PATENT DOCUMENTS

| | | | |
|---|---|---|---|
| 2,909,372 | 10/1959 | Neri | 273/422 |
| 4,029,319 | 6/1977 | Christen | 273/422 |
| 4,036,499 | 7/1977 | Sherwin | 273/422 |
| 4,210,330 | 7/1980 | Kosbab | 273/422 |
| 4,212,463 | 7/1980 | Repinski et al. | 273/422 X |

*Primary Examiner*—Paul E. Shapiro

*Attorney, Agent, or Firm*—Fisher, Christen & Sabol

[57] ABSTRACT

An arrowhead of the type where several L-shaped thin blades are interchangeably secured to an elongated body, each end of each blade being removably received in separate narrow axial recesses in the body, at least one end of the body being slotted to form inwardly compressible segments which define slots for one end of each blade, with a threaded member being mounted on the end of the body to compress the segments and tightly grip those ends.

11 Claims, 4 Drawing Figures

FIG.3
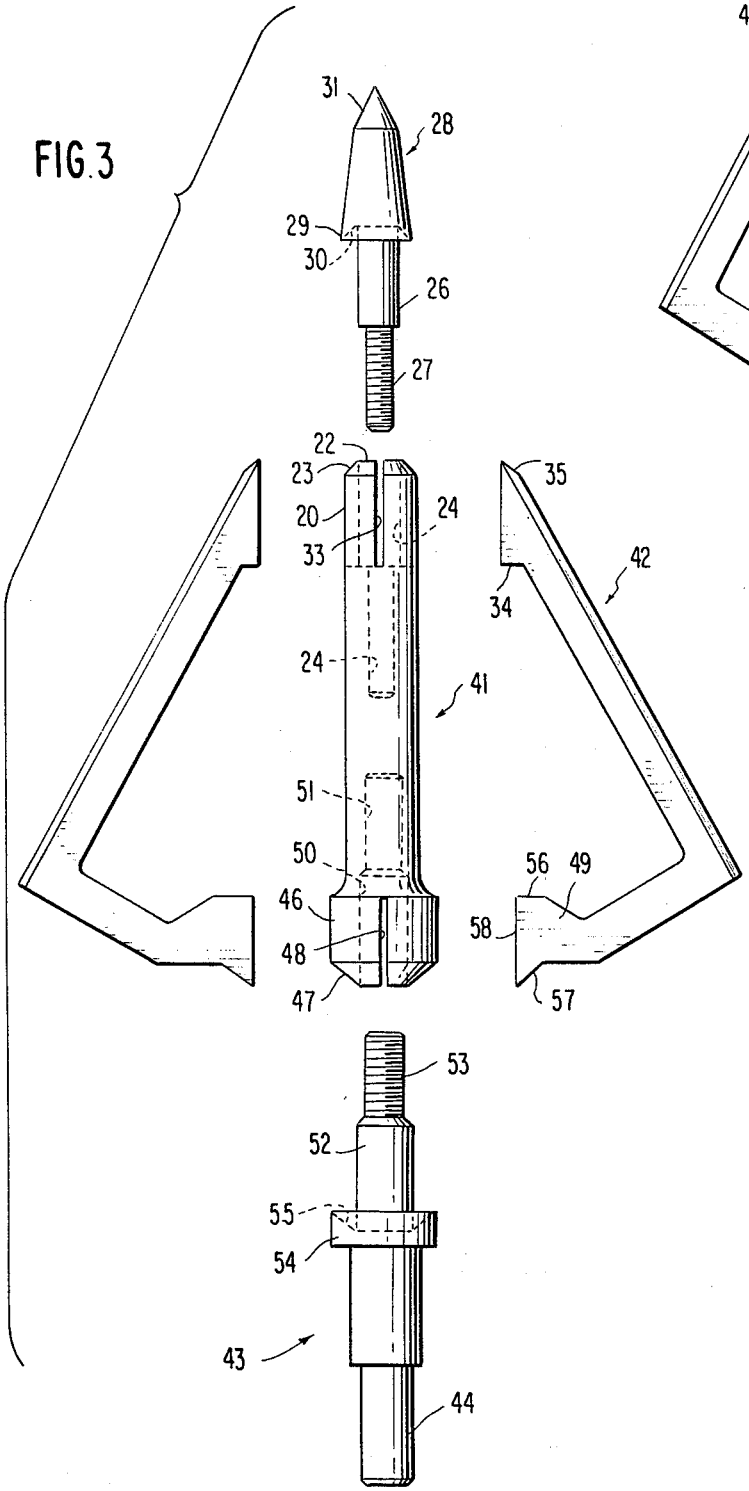
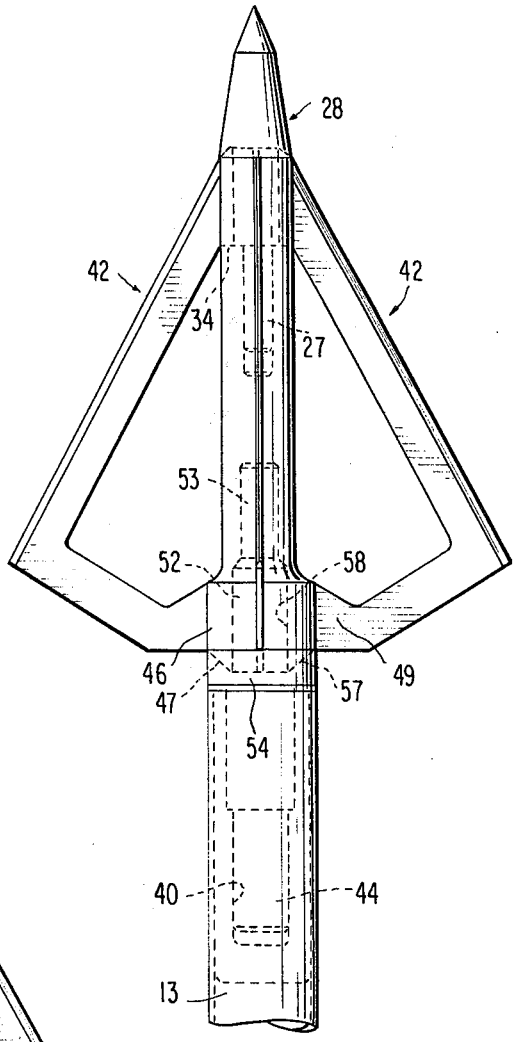
FIG.4

ARROWHEAD HAVING MODULAR REMOVABLE BLADES

CROSS-REFERENCE TO OTHER APPLICATION

This is an improvement on the invention disclosed and claimed in my copending application Ser. No. 156,751, filed June 5, 1980.

BACKGROUND OF THE INVENTION

This invention relates to an arrowhead having interchangeably replaceable blades.

In said prior application an arrowhead comprises an elongated body made of metal or hard plastic which is secured to the forward end of an arrow shaft to removeably secure a plurality of generally L-shaped blades made of thin metal of the type generally used for making razor blades. The two arms of the blades are relatively narrow and are each received at their respective free ends with axially extending slots, or recesses at the respective ends of the body so that each blade as a whole extends outwardly from the body in the form of a triangle defining a relatively large triangular opening between the inner margins of the arms and the body. By virtue of the narrow width of the arms and the comparatively large opening defined thereby, the blades display a leading portion having a tapered leading cutting edge of relatively long length as compared to the conventional triangular blade, with larger central opening which results in lighter weight and less wind resistance to axial rotation of the arrow while in flight. This is made possible by the fact that the free ends of both arms of each blade are firmly locked in place in the body against axial displacement in either direction.

Arrowheads having a superficial resemblance to the present invention are disclosed in U.S. Pat. Nos. 3,398,960; 2,912,247 and 2,909,372, but in each case, among other patentable distinctions, the blades are not individually removeable. Arrowheads having triangular blades are disclosed in U.S. Pat. Nos. 4,210,330; 4,169,597; 4,146,226; 4,036,499 and 4,006,901.

BRIEF SUMMARY OF THE INVENTION

In a preferred embodiment of the invention the elongated body is provided with a series of axially extending grooves at its rearward end to receive the rear ends of the L-shaped blades while the forward ends of the blades are received in axially extending slots which extend inwardly from the front end of the body to define segmented portions of the body. The forward ends of these segments have convex end surfaces and a removable tip is threadedly received in an axial bore. The lower face is concave, so that when it is screwed down tightly against the ends of the segments they are compressed inwardly to tightly grip the sides of the forward arms of the blade and this prevents any "flapping" of these arms. The grooves at the rearward end of the body are of sufficient length to accommodate a small axial projection on the rear blade arm therein and a retaining ring encircles the body so that the rear is inserted by a tilting motion which allows the projection to first enter the groove and to move behind the ring to lock the rear arm in place.

In another form of the invention the rearward end of the body is attached to the arrow shaft by an axially interposed connector which has a threaded shank received in a cooperating axial bore in the body. In this case the rearward end of the body is transversely slotted to provide a series of segmental portions between which the rear ends of the blades are received and the end surfaces of the segments are convex so as to cooperate with a concave end surface of the connector to be inwardly compressed to grip the sides of the blades when the connector is screwed tightly against the end of the body.

When both the forward and rearward ends of the body are slotted to permit the segmented portions to tightly grip both the front and rear extremities of the blades, it is possible to insert and remove individual blades without tilting when the tip and connector are unscrewed a sufficient amount to permit clearance for passage of the small projections at the ends of the blades in a radial direction.

BRIEF DESCRIPTION OF THE DRAWINGS

FIG. 3 is an exploded side view of a modified form of arrowhead, and;

FIG. 4 is a side view of the arrowhead of FIG. 3 when assembled.

DETAILED DESCRIPTION OF THE INVENTION

Figure 1:
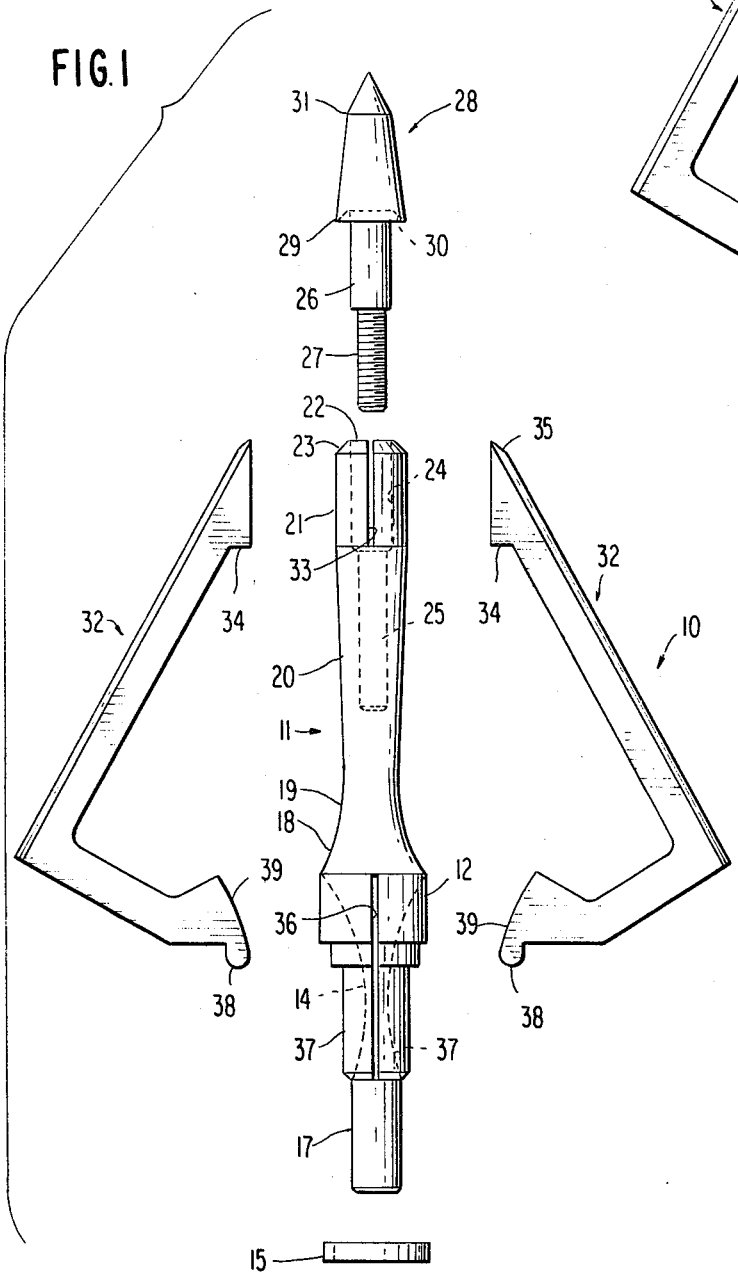
FIG. 1 is an exploded side view of a preferred form of modular arrow head constructed in accordance with this invention.
Figure 2:
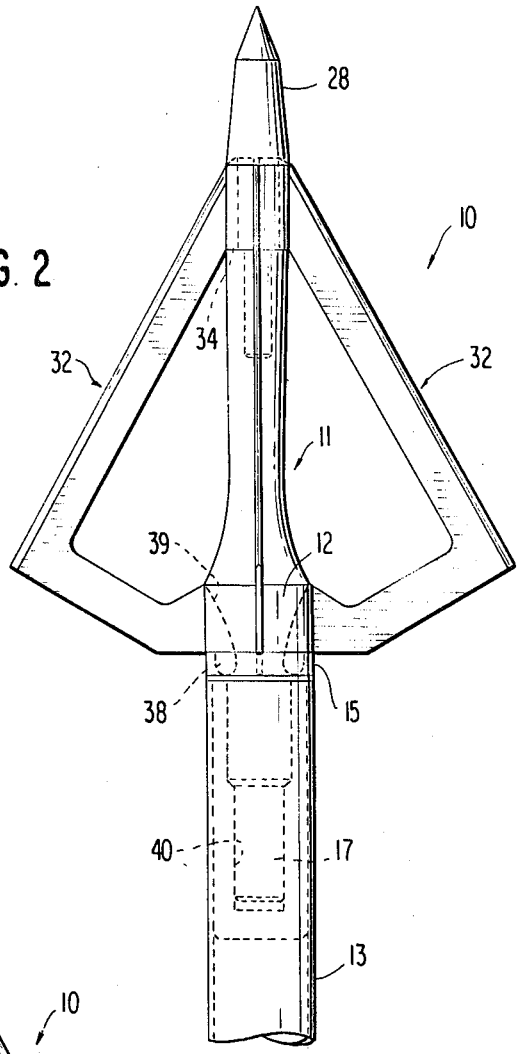
FIG. 2 is a side view of the arrowhead of FIG. 1 when assembled.

In FIGS. 1 and 2 the arrowhead indicated generally by numeral 10 consists of an assembly of interfitting parts which is manufactured to close tolerances so as to be fully interchangeable in order to permit replacement of any of the elements of the assembly that may become broken or lost, as well as to permit assembly by the user from a stock of separate parts.

The elongated body, indicated generally by numeral 11, is preferably made of a light, but durable, metal, is formed with a cylindrical blade-retaining collar 12 at its rear end whose diameter is approximately the same as that of the forward end of the arrow shaft 13 which will support it. A short length of the rear end of the collar is turned down to provide a circular ledge 14 intended to slidably receive a circular blade retaining ring 15 whose outer diameter conforms to that of the adjacent collar and arrow shaft. A rearwardly projecting supporting shank extends for a substantially length beyond the ledge 14 to provide a first section 16 having a further reduced diameter and a terminal section 17 having a still further reduced diameter, for reasons which will be explained.

Beginning immediately forward of the collar 12 the main portion of the body is progressively reduced in diameter, as at 18, rather abruptly until a minimum cross-section is reached at 19, about one-third of the way from the rear end, after which the cross-section of the forward two-thirds of the surface 20 of the body may be gradually increased to provide a slightly outwardly directed tapering form until the forward end 21 of the body is reached, at which point it is perferably that the maximum diameter should be considerably less than that of the rear end at collar 12. The front end face 22 is joined to the peripheral surface of the body by an annular convex, or conical, surface 23 and extending axially inwardly from the end of the body there is a central bore having a cylindrical first section 24 and a terminal threaded section 25 of reduced diameter, designed to receive, respectively, the cylindrical shank portion 26 and the threaded end portion 27 of a forwardly located tip, indicated generally by numeral 28, whose base portion 29 is of approximately the same outer diameter at the front end 20 of the body so as to provide an annular rear face 30 which is formed with a concave, or internal conical surface which mates with the end surface 23 of the body. The external forward surface 31 of tip 28 may be of any conventional construction, although, for convenience a generally conical shape has been shown in the drawings.

The body 11 is intended to firmly support an even number of individual generally L-shaped interchangeable blades fabricated, as by stamping, from the same type of metal used for the making of razor blades, and are indicated generally by numeral 32. In the embodiment shown in the drawings four such blades are shown although, obviously two could be used, or as many as six or more.

For mounting the blades the front end of the body is provided with a narrow slot 33 extending axially inwardly from the end face 22 along a diametrical plane for each pair of blades; that is to say, two slots disposed radially at right angles to each other are required for the four blades 32. The axial lengths of these slots should such that the inwardly extending projection 34 at the forward end of each blade will be seated at the inner end of each slot when the forward tip 35 of each blade is in radial alignment with the end face 22 of the body. For convenience in manufacture, slots 33 can be made by means of a thin rotary metal saw having a thickness to make a slot wide enough to permit easy insertion and removal of the forward tips of the blades.

An added benefit arises from the fact that the same saw may also be used to cut a series of axially extending grooves 36 at the rear end of the body to receive the rearward ends of blades 32, there being four grooves in all for four blades. Care must be taken to ensure that these grooves lie in the corresponding diametrical planes as the slots 33 at the front end. As indicated by the broken lines 37 in FIG. 1 the inner surfaces of these grooves define arcs which extend from the forward end of collar 12 rearwardly to the forward end of the peripheral surface of terminal shank 17. It should be observed that the maximum depth of these grooves lies in the region of the ledge 14 so that when the retaining ring 15 is in place, a radial space is provided at that point which accommodates the projections 38 out the rearmost ends of the blades 32. Furthermore, to facilitate insertion and removal of the blades and maintain firm support, the inner rear margins 39 of each blade may be formed to define arcs of a circle coinciding with the radii of the circles defining the inner surfaces 37 of grooves 36.

The forward end of the arrow shaft 13 is provided with an inwardly extending stepped coaxial bore 40. While this bore and at least a portion of shank 17 could be threaded, in this modification the bore is dimension so that the body 11 be held securely in place by press fitting the shank 17 into the bore 40, care be taken to be sure that the ring 15 is in place, encircling the ledge 14 before the shank is inserted into the bore and the depth of the bore should be sufficient to cause the ring to abut against the lower end of collar 12.

To assemble the blades 32 on the body each blade in succession is held first in such a way that the lower projection 38 may first be inserted into one of the grooves 36, after which it is pushed down behind the retaining ring 15 while the blade as a whole is tilted to bring the upper end of the blade inwardly to be introduced into the corresponding one of the slots 33. At this point the shank 27 of the tip 28 should be at least partially unscrewed from the bore 24, to allow the upper end 35 of each blade to pass under the lower end 29 of the tip and to fully enter the slot so as to allow the terminal margin of the blade to abut against the cylindrical shank 26. After all of the blades are in place the tip is screwed down to bring the concave inner surface into engagement with the conical surface 23. Further rotation of the tip in the same direction, while the body 11 is firmly held, will cause the elongated segmental portions of the body adjacent the slots 33 to be drawn slightly inwardly towards each other at their upper ends to tightly grip each of the upper ends of the blades in their slots which will prevent them from "flapping" when the arrow is in flight. To remove a blade, the tip is loosened to allow the upper end of the blade to be pulled out of the slot to allow the lower end to be removed from a groove 36 after further outward tilting of the blade.

In the modified form of the invention shown in FIGS. 3 and 4, the tip 28, the upper end of the body 41 and the manner in which the upper ends of the L-shaped blades 42 are secured in place are substantially the same as shown in FIGS. 1 and 2. However, the body 41 is secured to the arrow shaft 13 by means of a separate coupling connector, indicated by numeral 43, which is provided at its lower end with a stepped shank 44 which is force-fitted into the recess 40 in the arrow shaft.

While the main portion 45 of the body 41 may be tapered, as previously described, the exterior surface is shown as an depending cylindrical extension of the upper collar 20 which tapers outwardly at its lower end to merge with the external cylindrical surface of a lower collar 46 and terminates at its lower end with a convex, or conical radial surface 47. The lower end of the body is also provided with axially inwardly directed diametrically extending slots 48 to receive the lower ends 49 of the blades.

The lower end of the body 41 is also provided with an inwardly directed coaxial stepped bore having a cylindrical entrance portion 50 and a further threaded portion 51 of smaller diameter to receive respectively, the cylindrical portion 52 and threaded portion 53 of an upper stepped shank of connector 42. An annular flange 54 projects outwardly from the connector 42 at the base of cylindrical portion 52, the upper surface of the flange being provided with an inwardly and downwardly directed annular concave recess 55 which is designed to mate with the convex surface 47 of the body.

It should also be observed that the lower ends 49 of the blades are provided with a horizontal upper margin aligned with the upper ends of the slots 48, a downwardly angled lower side margin 57 which lies flush with, or slightly above, the convex surface 47 when in place and a vertical end margin 58 which abuts against cylindrical surface 52 when inserted into a slot.

There are three ways in which one or more of blades 42 can be attached to body 41. First, body 41 may be screwed down on the connector 42 so that flange 54 is just in contact with surface 47. In this conidtion, with the tip 28 partially unscrewed as in the first embodiment the lower projection is first inserted into a slot 48 and the blade is tilted up to insert the upper end into a slot 33, causing the remainder of the lower end to end slot 48. Following this the body 41 is rotated further to compress the lower segments adjacent slots 48 to firmly grip the lower ends of the blades and there the tip 28, as before, to firmly grip the upper ends of the blades in slots 33.

A second way is to screw the tip 28 down into light contact with convex surface 23 and to partially unscrew the body 41 from connector 42. In this condition the tip 35 at the upper end of the blade is inserted first into a slot 33 and the blade is tilted downwardly to insert the lower end 49 into a slot 48, which is possible if the flange 54 is spaced far enough from the end of the body to allow the projection 57 to pass in a horizontal direction. The body is then screwed down tightly against the surface 23 to firmly grip both ends of the blades.

A third way is to start with both the body 41 partially unscrewed from connector 42 and tip 28 unscrewed from the body a sufficient amount so that both the upper projection 35 and the lower projection 57 will leave sufficient clearance to allow them both to move in a radial direction into their respective slots 33 and 48 without the necessity for any tilting of the blades. As before, both ends of the blades will be firmly gripped when the body and tip and tightened against the connector and body respectively.

What is claimed is:

1. In an arrowhead of the type wherein a plurality of interchangeably L-shaped blades are removably mounted on an elongated body, the combination comprising:

one end of said body being inwardly slotted in an axial direction to provide inwardly compressible axially extending segments defining at least one slot to receive one end of a blade;

adjustable compressing means mounted on said one end of the body to compress said segments inwardly to immovably grip said one end of a blade;

a second slot provided in said body axially spaced from said one slot to receive the other end of said blade;

and means on the body axially spaced from said first slot to immovably attach the other end of said blade in the second slot in said body.

2. Arrowhead as defined in claim 1, wherein the other end of said body inwardly recessed in an axial direction to receive the other end of said blade therein, the width of the terminal portion of said other end of the blade being wider in an axial direction than the portion projecting from said recess, and said additional means is provided to lock said terminal portion of the other end of the blade in said recess against removal in a radial direction when said one of the blade is received in said slot.

3. Arrowhead as defined in claim 2, wherein said means to lock said terminal portion of said other end of the blade comprises a ring-shaped element axially movable on said body over a portion of said recess, and means to retain said element in locking position.

4. Arrowhead as defined in claim 3, wherein said body is provided with an axially projecting shank to be secured within an axial bore in the end of an arrow shaft, said ring-shaped element abutting against the end of the shaft.

5. Arrowhead as defined in claim 1, wherein said comprising means comprises a member mounted in axial alignment with said one end of the body for movement in axial directions, said member having a concave end surface to urge the free ends of said segments radially inwardly when in axial abutment therewith.

6. Arrowhead as defined in claim 5, wherein the end surfaces of said segments together define a convex surface which mates with said concave surface of said member.

7. Arrowhead as defined in either one of claims 5 or 6, wherein the terminal portion of said one end of the blade inserted into said slot has a width greater in the axial direction than that of the portion projecting from the slot whereby when said member is moved into engagement with the end surfaces of the segments said one end is radially locked in place, said member being moved in the opposite axial direction to insert and remove said one end.

8. Arrowhead as defined in claim 7, wherein said axially movable member is provided with an axially projecting shank received in an axially extending bore in the body, at least a portion of the shank and bore being complementarily threaded.

9. Arrowhead as defined in claim 8, wherein said threaded portions are located axially inwardly of said slot and the terminal portion of said one end of the blade is provided with an end margin to abut against said shank.

10. Arrowhead as defined in claim 9, wherein said axially movable member comprises a removable tip for the arrowhead.

11. Arrowhead as defined in claim 9, wehrein said axially movable member comprises a coupling member for attaching said body to the end of an arrow shaft.

* * * * *